US007081875B2

(12) United States Patent
Yokoyama et al.

(10) Patent No.: US 7,081,875 B2
(45) Date of Patent: Jul. 25, 2006

(54) DISPLAY DEVICE AND ITS DRIVING METHOD

(75) Inventors: Ryoichi Yokoyama, Ohgaki (JP); Kiyoshi Yoneda, Motosu-gun (JP)

(73) Assignee: Sanyo Electric Co., Ltd., Osaka (JP)

( * ) Notice: Subject to any disclaimer, the term of this patent is extended or adjusted under 35 U.S.C. 154(b) by 277 days.

(21) Appl. No.: 09/953,584

(22) Filed: Sep. 17, 2001

(65) Prior Publication Data

US 2002/0036613 A1 Mar. 28, 2002

(30) Foreign Application Priority Data

Sep. 18, 2000 (JP) ..... 2000-282175

(51) Int. Cl.
*G09G 3/36* (2006.01)

(52) U.S. Cl. ..... 345/90; 345/92; 345/98

(58) Field of Classification Search ..... 345/204–205, 345/87, 90, 92, 98, 100, 103, 211–214
See application file for complete search history.

(56) References Cited

U.S. PATENT DOCUMENTS

| | | | | |
|---|---|---|---|---|
| 4,432,610 A | | 2/1984 | Kobayashi et al. | |
| 5,627,557 A | * | 5/1997 | Yamaguchi et al. | 345/90 |
| 5,712,652 A | | 1/1998 | Sato et al. | |
| 5,790,090 A | | 8/1998 | Libsch et al. | |
| 5,945,972 A | * | 8/1999 | Okumura et al. | 345/98 |
| 5,952,991 A | | 9/1999 | Akiyama | |
| 5,959,598 A | | 9/1999 | McKnight | |
| 5,977,940 A | | 11/1999 | Akiyama et al. | |
| 6,023,308 A | | 2/2000 | Takemura | |
| 6,072,454 A | | 6/2000 | Nakai et al. | |
| 6,127,998 A | * | 10/2000 | Ichikawa et al. | 345/100 |
| 6,166,726 A | * | 12/2000 | Uchida et al. | 345/211 |
| 6,552,705 B1 | * | 4/2003 | Hirota | 345/92 |
| 2003/0103023 A1 | * | 6/2003 | Ootsuka et al. | 345/87 |

FOREIGN PATENT DOCUMENTS

| | | |
|---|---|---|
| EP | 0544461 A | 6/1993 |
| EP | 0 797 182 | 9/1997 |
| EP | 1 020 840 | 7/2000 |
| JP | 56-117275 A | 9/1981 |

(Continued)

OTHER PUBLICATIONS

European Search Report dated Feb. 9, 2004, directed to counterpart foreign application.

*Primary Examiner*—Amr A. Awad
*Assistant Examiner*—Leonid Shapiro
(74) *Attorney, Agent, or Firm*—Morrison & Foerster LLP

(57) ABSTRACT

In the display device having the retaining circuit for holding the digital image data at the pixel element, the power voltage supplied to the retaining circuit 110 is set up to be at the minimum level for the retaining circuit to hold the data during the data writing period, but the voltage supplied to the retaining circuit is raised by the voltage booster 95 upon the completion of the data writing. The retaining circuit 110 takes in the digital image signal fed from the drain signal line 61 in response to the signal fed from the gate signal line 51 and holds the digital image signal. Then, the display is carried out according to the signal held by the retaining circuit 110. By this, the erroneous writing of the data to the retaining circuit is prevented. The reduction of the electric power consumption and the high density integration of the pixel elements are also possible.

10 Claims, 6 Drawing Sheets

FOREIGN PATENT DOCUMENTS

| | | |
|---|---|---|
| JP | 6-250615 | 9/1994 |
| JP | 08-194205 | 7/1996 |
| JP | 8-286170 | 11/1996 |
| JP | 09-236823 | 9/1997 |
| JP | 2001-242819 | 9/2001 |

* cited by examiner

DISPLAY DEVICE AND ITS DRIVING METHOD

FIELD OF THE INVENTION

This invention relates to a display device and its driving method, especially to a display device which is incorporated into a portable communication and computing device.

BACKGROUND OF THE INVENTION

There has been a great demand in the market for portable communication and computing devices such as a portable TV and cellular phone. All these devices need a small, light-weight and low-power consumption display device, and development efforts have been made accordingly.

FIG. 7 shows a circuit diagram corresponding to a single pixel element of a conventional liquid crystal display device. A gate signal line 51 and a drain signal line 61 are placed on an insulating substrate (not shown in the figure) perpendicular to each other. A pixel element selection TFT 65 connected to the two signal lines 51, 61 is formed near the crossing of the two signal lines 51, 61. The source 11*s* of the TFT 65 is connected to a pixel electrode 80 of the liquid crystal 21.

A storage capacitor element 85 holds the voltage of the pixel electrode 80 during one field period. A terminal 86, which is one of the terminals of the storage capacitor element 85, is connected to the source 11*s* of the TFT 65, and the other terminal 87 is provided with a voltage common among all the pixel elements. When a scanning signal is applied to the gate signal line 51, the TFT 65 turns to an on-state.

Accordingly, an analog image signal from the drain signal line 61 is applied to the pixel electrode 80, and the liquid crystal 21 through the pixel electrode 80, and the storage capacitor element 85 holds the voltage. The voltage of the image signal is applied to the liquid crystal 21 through the pixel electrode 80, and the liquid crystal 21 aligns in response to the applied voltage for providing a liquid crystal display image. This configuration is capable of showing both moving images and still images. There is a need for the display to show both a moving image and a still image within a single display. One such example is to show a still image of a battery within area in a moving image of a portable telephone display to show the remaining amount of the battery power.

However, the configuration shown in FIG. 7 requires a continuous rewriting of each display to provide a still image. This is basically to show a still-like image in a moving image mode, and the scanning signal needs to activate the TFT 65 at each scanning.

Accordingly, it is necessary to operate a driver circuit which generates a drive signal for the scanning signals and the image signals, and an external LSI which generates various signals for controlling the timing of the drive circuit, resulting in a consumption of a significant amount of electric power. This is a considerable drawback when such a configuration is used in a portable telephone device, which has only a limited power source. That is, the time a user can use the telephone under one battery charge is considerably short.

Japanese Laid-Open Patent Publication No. Hei 8-194205 discloses another configuration for display device suited for portable applications. This display device has a static memory for each of the pixel elements, as shown in FIG. 8. A static memory, in which two inverters INV1 and INV2 are positively fed back to each other, holds the image signal for reducing the power consumption. In this configuration, a switching element 24 controls the resistance between a reference line and a pixel electrode 80 in response to the divalent digital image signal held by the static memory in order to adjust the biasing of the liquid crystal 21. The common electrode, on the other hand, receives an AC signal Vcom. Ideally, this configuration does not need refreshing the memory when the image stays still for a period of time.

As described above, the display device equipped with a static memory for holding digital image signals is suitable for displaying a still image with shallow depth and reducing the consumption of the electric power.

However, the display device with above configuration has the following problem, which will be explained by referring to FIG. 9. Suppose the source 11*s* of the pixel element selection TFT 65 is held at L (low) level and the output node of the inverter INV1 is held at H (high) level. Under this circumstance, when a H signal is outputted from the external circuit, fed to the drain signal line 61 and written to the static memory, the electric current goes through from the drain signal line 61 to the TFT 65 to N-channel type TFT as shown by the broken line in the figure, since the N-channel type TFT of the inverter INV2 is in an on-state. Therefore, the H level is effected by the L level, resulting in the possibility of the erroneous writing due to the decrease in H level.

In order to write the H data correctly, the voltage of source 11*s* of the TFT 65 should be higher than the threshold voltage of the inverter INV1. However, there is a possibility of the decrease in the voltage of the source 11*s* of the TFT 65 because of the passage of the electric current stated above. Therefore, the following measures can be taken for solving the above problem.

1) To increase the voltage of the H level supplied to the drain signal line 61 from the external circuit.
2) In order to decrease the on-state resistance of the pixel element TFT 65, the voltage should be increased when the gate signal line 51 is selected, or the channel width of the TFT 65 should be expanded.

However, the first measures have the problem of the increased energy consumption due to the increased voltage of the external circuit. And the second measures have problems of the increased voltage of the gate driver and the increased size of the TFT. It also has the difficulty in the layout of the pixel elements with fine pitch.

SUMMARY OF THE INVENTION

This invention is directed to the prevention of the erroneous writing of the data to the static memory in a display device with a static memory for holding digital image data at pixel elements. This invention is also directed to the reduction of the consumption of the electric power and the fine layout of the pixel elements.

According to the first configuration of this invention, there is provided a display device having a plurality of gate signal lines disposed in a predetermined direction on a substrate, a plurality of drain signal lines disposed in a direction perpendicular to the predetermined direction, a plurality of pixel elements which are disposed as a matrix, activated by the scanning signal fed through the gate signal line and provided with the image signal fed through the drain signal line, a retaining circuit in which a digital image signal fed from the drain signal line is written in response to a signal fed from the gate signal line and which holds said digital image signal, and a voltage booster which raises a power voltage supplied to the retaining circuit upon a completion of writing of the digital image signal wherein outputs of the retaining circuit determine a representation of the digital image.

According to this configuration, the power voltage supplied to the retaining circuit is kept at low level, which is just enough for holding a digital image signal in the retaining circuit, during a writing period, and the voltage is raised to have a quality display after the writing period. Thus, it is possible to prevent the erroneous writing of data to the retaining circuit and to reduce the consumption of the electric power.

Also, according to the above configuration, since a pixel element selection element can be made small, the fine layout of the pixel elements is possible.

It is also possible to limit the number of the circuit elements by forming the retaining circuit from the two inverter circuits which are positively fed to each other. It is preferable that the inverter circuit be a CMOS inverter circuit for the reduction of the consumption of the electric power.

There is also provided in the display device, a signal selection circuit which selects a signal to be supplied to a pixel electrode in response to the outputs of the selection circuit, said signal selection circuit comprising a plurality of thin film transistors to gates of which are applied the outputs of the retaining circuit. This configuration enables the display corresponding to the outputs from the retaining circuit and the reduction in the number of the circuit elements of the signal selection circuit.

In the above configuration, the power voltage raised by the voltage booster is higher than a sum of a voltage of the signal to be supplied to the pixel electrode and a threshold voltage of the thin film transistor. Since this prevents the reduction of the signal supplied to the pixel electrode, it is possible to have a high quality screen display with a sharp contrast.

According to this invention, there is also provided a method for driving a display device. The method utilizes the display device described above, and comprises rising the power voltage supplied to the retaining circuit using the voltage booster upon a completion of writing of the digital image signal fed from the drain signal line in response to the signal fed from the gate signal line, and displaying the digital image in accordance with the digital image signal.

According to this configuration, the erroneous writing of the digital image signal to the retaining circuit is prevented and the consumption of the electric power can be reduced.

DETAILED DESCRIPTION OF THE INVENTION

Figure 1:
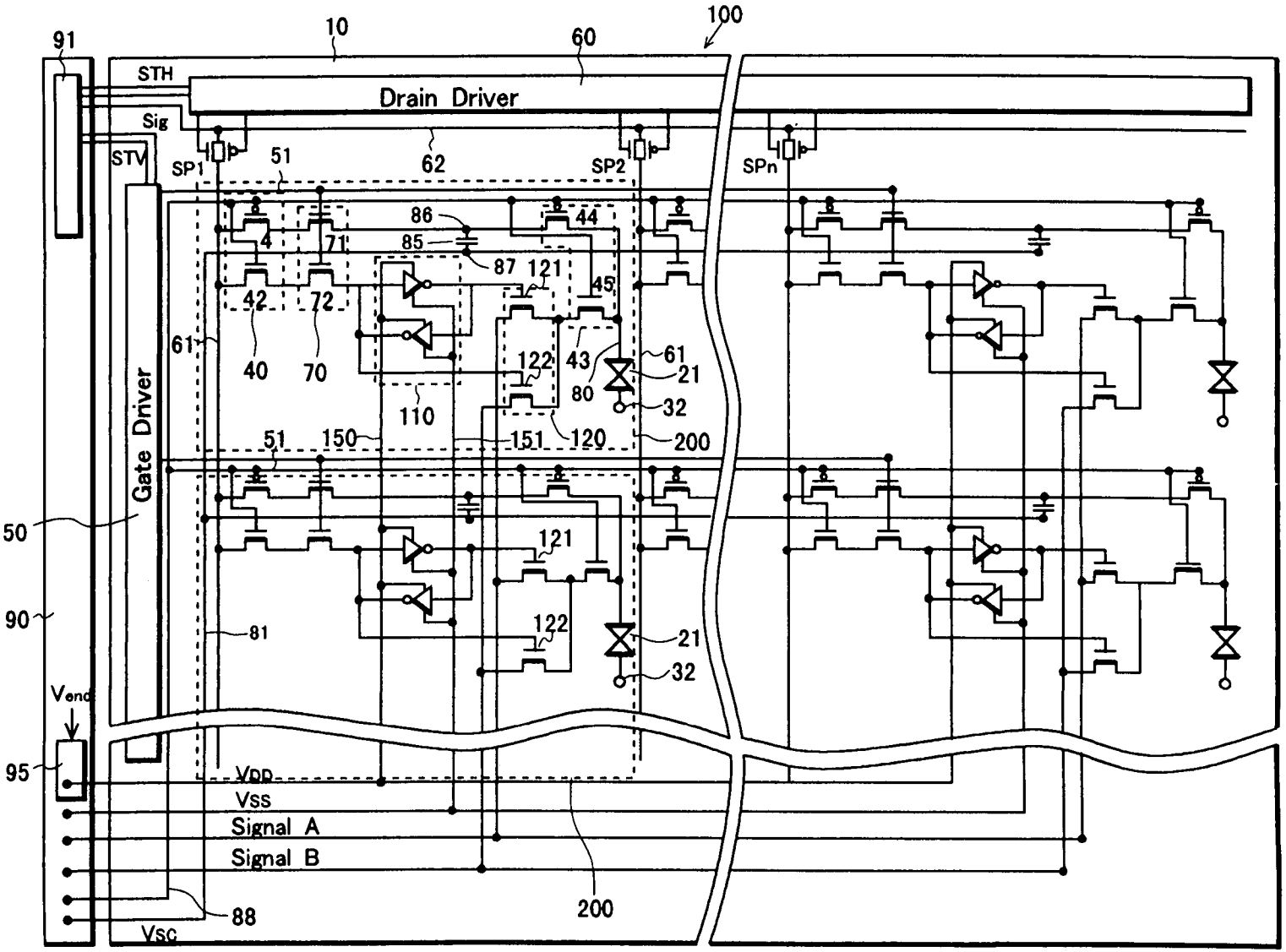
FIG. 1 is a circuit diagram of a liquid crystal display device of the first embodiment of this invention.

FIG. 1 shows a circuit diagram of a liquid crystal device to which the first embodiment of the display device of this invention is applied.

On an insulating substrate 10, a plurality of gate signal lines 51 connected to a gate driver 50 for providing scanning signals are aligned in one direction. A plurality of drain signal lines 61 are aligned in the direction perpendicular to the direction of the gate signal lines 51.

Sampling transistors SP1, SP2, . . . , SPn turn on in response to the timing of the sampling pulse fed from the drain driver 60, and connect the drain signal lines 61 to the data signal lines 62 carrying the data signal, which is the digital image signal or the analog image signal.

The display panel 100 consists of a plurality of pixel elements 200 provided in a matrix configuration. These pixel elements 200 are selected by the scanning signal fed from the gate signal line 51 and receive the data signal fed from the drain signal line 61.

A circuit selection circuit 40 having a P-channel TFT 41 and a N-channel TFT 42 is placed near the crossing of the gate signal line 51 and the drain signal line 61. The drains of TFTs 41, 42 are connected to the drain signal line 61 and the gates of the two TFTs are connected to the circuit selection signal line 88. One of the two TFTs 41, 42 turns on in response to a selection signal fed from the circuit selection signal line 88. As described below, the circuit selection circuit 43 comprising a P-channel TFT 44 and a N-channel TFT 45 is provided to cooperate with the circuit selection circuit 40.

A pair of the two circuit selection circuits 40 and 43 enables the switching between the analog image display (full color moving image) and the digital image display (still image and low energy consumption). A pixel element selection circuit 70 having a N-channel TFT 71 and a N-channel TFT 72 is placed next to the circuit selection circuit 40. The TFTs 71, 72 are connected to the TFTs 41, 42 of the circuit selection circuit 40 in series, and both gates of the TFTs 71, 72 are connected to the gate signal line 51. Both of the TFTs 71, 72 turn on at the same time in response to the scanning signal fed from the gate signal line 51.

A storage capacitor element 85 holds the analog image signal in the analog mode. The electrode 86, which is one of the electrodes of the storage capacitor element 85, is connected to the source 71*s* of the TFT 71. Another electrode 87 is connected to a common storage capacitor line 81 carrying a bias voltage Vcs. In the analog mode, when the analog image signal is applied to the liquid crystal 21 after the opening of the gate of the TFT 71, the voltage of the applied signal is reduced even during a one field period, resulting in a loss of the homogeneity of the displayed image. The storage capacitor element 85 maintains the applied voltage at the initial level during one field period for eliminating the problem above.

A P-channel TFT 44 of the circuit selection circuit 43 is placed between the storage capacitor element 85 and the liquid crystal 21, and turns on and off in synchronization with the switching of the TFT 41 of the circuit selection circuit 40. A retaining circuit 110 and a signal selection circuit 120 are placed between the TFT 72 of the pixel element selection circuit 70 and the pixel electrode 80 of the liquid crystal 21.

The retaining circuit 110 has two inverter circuits, which are positively fed back to each other, and forms a static memory of digital divalent. Here, it is preferable to use CMOS type inverter circuit, which consumes relatively small amount of static current, for the reduction of the consumption of the electric power.

The signal selection circuit 120 has two N-channel TFTs 121, 122, and selects a signal in response to the signal fed from the retaining circuit 110. Since two complementary output signals from the retaining circuit 110 are applied to the gates of the two TFTs 121, 122, respectively, only one of the two TFTs 121, 122 turns on at a time.

The AC drive signal (signal B) is selected when the TFT 122 turns on, and the common electrode signal Vcom (signal A) is selected when the TFT 121 turns on. The selected signal is then applied to the pixel electrode 80 of the liquid crystal 21 through the TFT 45 of the circuit selection circuit 43.

In the digital mode, a full dot scan is performed during one vertical period and the digital image data fed from the drain signal line 61 is written to the retaining circuit 110. Here, during the data writing period, the power voltage Vdd supplied to the two inverter circuits of the retaining circuit 110 is set up to be the minimum level (for example, of 3 V) necessary for the retaining circuit to hold the data. However, upon the completion of writing, the higher voltage is applied for the display (display of a still image) based on the data in the retaining circuit 110.

Here, it is desirable that the voltage Vdd be higher than the sum of the highest voltage of signal A, B and the threshold voltage (Vt) of TFTs 121, 122. That is, Vdd>Vt+Max. (signal A, signal B). About 8V is appropriate for the Vdd. If this condition is not fulfilled, the TFTs 121, 122 can not supply and recharge the pixel electrode 80 without lowering the level of signals A, B, resulting in the deterioration of the contrast in the liquid crystal display.

The liquid crystal display panel 100 has peripheral circuit as well. A panel drive LSI 91 is mounted on an external circuit board 90 fitted to the insulating substrate 10 of the liquid crystal panel 100, and sends the vertical start signal STV and the horizontal start signal STH to the gate driver 50 and the drain driver 60 respectively. The panel drive LSI also feeds the image signal to the data line 62.

On the external circuit board 90, a voltage booster 95 for raising the voltage Vdd supplied to the two inverter circuits of the retaining circuit 110, is mounted. The voltage booster 95 starts raising the voltage based on the writing period end signal Vend from a timing controller (not shown in the figure).

The signal Vend is generated based on the vertical synchronization signal Vsync coming from outside of the timing controller (not shown in the figure). But the vertical synchronization signal Vsync itself can be used as the signal as well. As to the voltage booster 95, a charge pump type circuit can be used.

Figure 2:
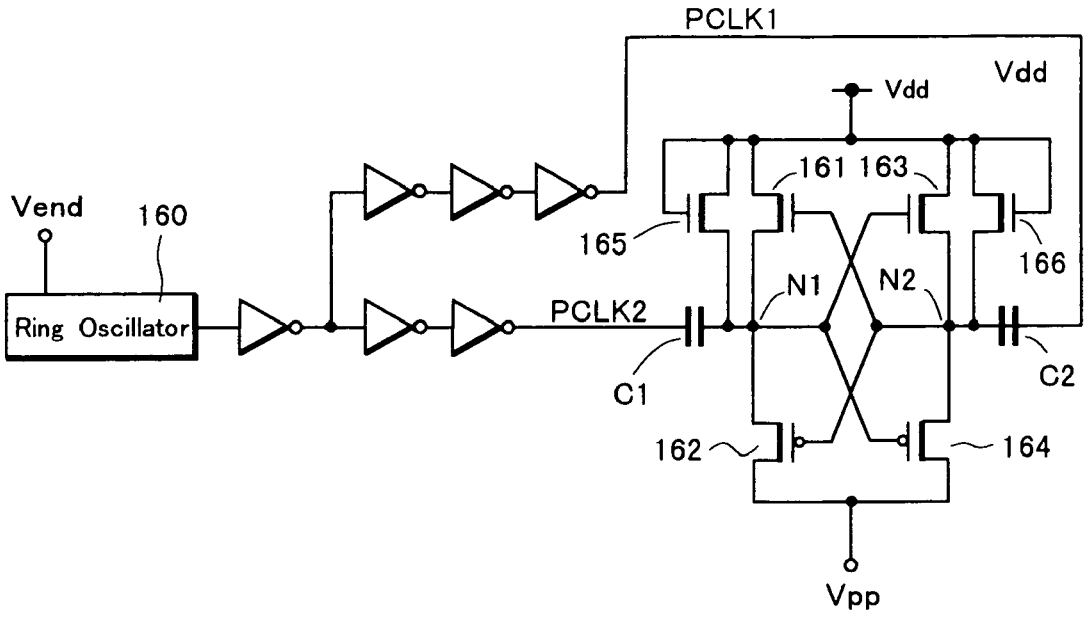
FIG. 2 is a circuit diagram of a voltage booster of the first embodiment of this invention.

FIG. 2 shows a circuit diagram of the voltage booster 95. In FIG. 2, numeral reference 160 is a ring oscillator, which starts oscillating in response to the wiring period end signal Vend. The oscillation clock of the ring oscillator 160 is applied to one end of each of the condensers C1 and C2 through inverter. The steps of the inverters are set up such that the clock PCLK2 applied to the condenser C1 and the clock PCLK1 applied to the condenser C2 are in reverse phase. Also, the power voltage of the ring oscillator 160 and the inverters is Vdd. Therefore, the amplitudes of the clock PCLK 1 and the clock PCLK 2 are also Vdd.

One end of the condenser C1 is connected to the connection point N1 in which the TFT 161 and the TFT 162 is connected. The other end of the condenser C1 is connected to the connection point N2 in which the TFT 163 and the TFT 164 is connected. Here, the TFT 161 and the TFT 163 are N-channel type and the sources of these TFTs are provided with the power voltage Vdd (for example, of 3V). The TFT 162 and the TFT 164 are P-channel type, and the sources of these TFTs are connected with each other. The ascended voltage Vpp is provided by this common source.

Also, the TFT 165 is provided for setting up the initial voltage at the connection point N1 same as the power voltage Vdd in the initial state. Likewise, the TFT 166 is provided for setting up the initial voltage at the connection point N2 same as the power voltage Vdd in the initial state. Both the TFT 165 and the TFT 166 are N-channel type, and the gate and source of these TFTs are provided with the power voltage Vdd.

The operation of the booster described above will be explained below. When the ring 10, oscillator 160 starts oscillating in response to the writing period end signal Vend, the clock PCLK 2 is applied to the condenser 1 and clock PCLK 1, which is in the reverse phase against the clock PLCK 2, is applied to the condenser 2 respectively. When the clock PLCK 2 is at high level, the voltage at the connection point N1 raises because of the capacitance coupling. If the capacitance of the condenser C1 is larger than the parasitic capacitance attached to the connection point N1, the voltage at the connection point N1 will be 2Vdd. For example, if the Vdd is 3V, the voltage at the connection point N1 will be 6V. In this case, the TFT 162 and the TFT 163 turn on and the voltage Vpp of 6V raised through the TFT 162 is outputted.

When clock PLCK 2 goes down to the low level and the clock PCLK1 rises to the high level, the voltage at the connection point N2 rises because of the capacity coupling. If the capacitance of the condenser C2 is larger than the parasitic capacitance attached to the connection point N2, the voltage at the connection point N2 will be 2Vdd. For example, if the Vdd is 3V, the voltage at the connection point N2 will be 6V. By this, the TFT 162 and the TFT 163 turn off and the TFT 161 and the TFT 164 turn on. Then, the voltage Vpp of 6V raised through the TFT 164 is outputted. By repeating this operation, the power voltage Vdd is raised to the voltage Vpp and outputted.

Figure 3:
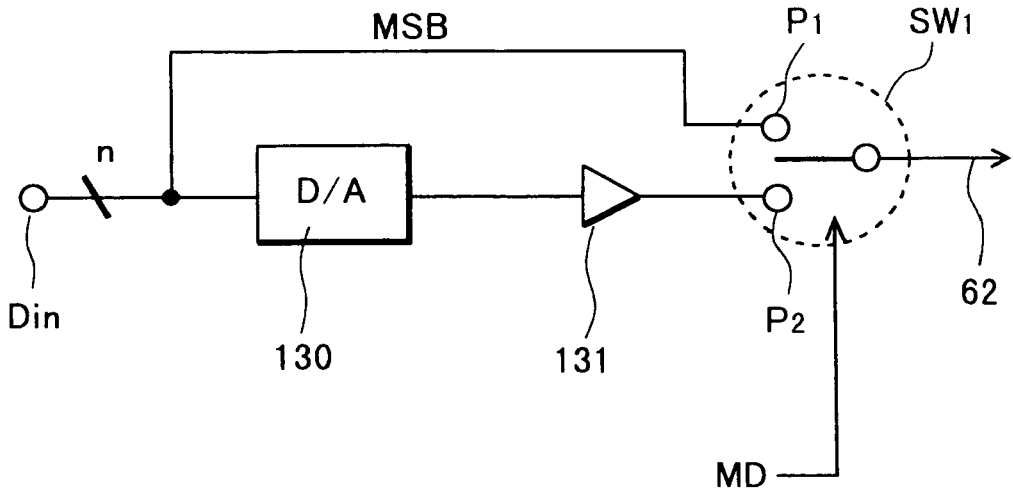
FIG. 3 is a circuit diagram of the switching circuit for the image signal of the first embodiment of this invention.

FIG. 3 is a circuit diagram of the switching circuit of the image signal. When the switch SW1 is connected to the terminal P2 side, the digital image signal with a n-bit is inputted from the input terminal Din, and then fed to the data line 62 after being converted to an analog image signal by a DA converter 130.

On the other hand, when switch SW1 is changed to the terminal P1 side, the highest bit of the n-bit digital image signal is outputted to the data line 62. The change of the switch SW1 is done according to the mode-switching signal MD, which controls the switching between analog display mode and digital display mode for reducing the consumption of the electric power.

Figure 4:
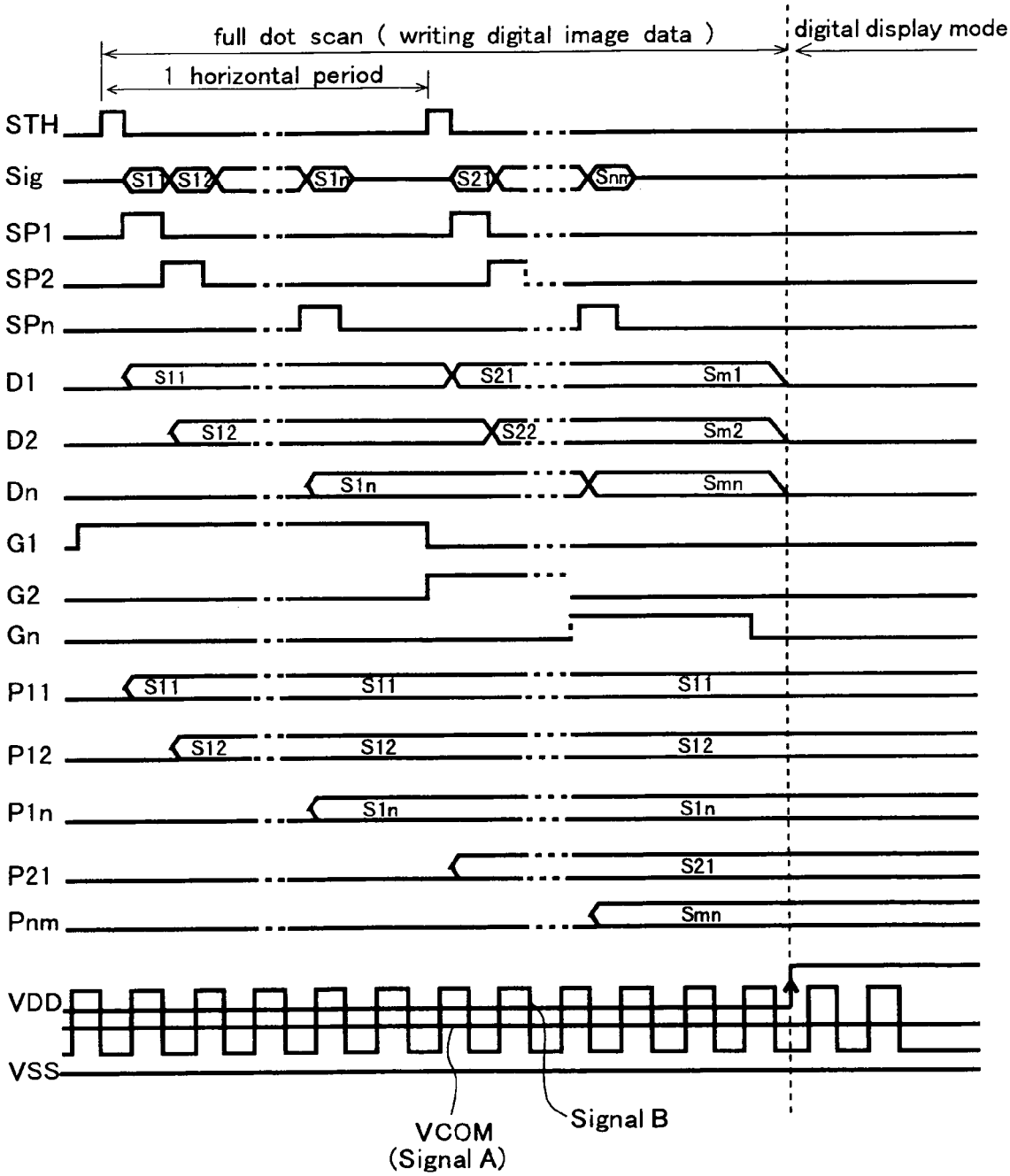
FIG. 4 is a timing chart of the liquid crystal display device of the first embodiment of this invention

A driving method of the display panel having the configuration above will be described below in reference to FIGS. 1–4. FIG. 4 shows a timing chart when the liquid crystal display device is set to operate under the digital display mode.

(1) Analog Display Mode

The analog display mode is selected in response to the display mode selection signal MD. Then, the analog image signal is fed to the data line 62, and the voltage applied on the circuit selection signal line 88 changes to L so that the TFTs 41, 44 of the circuit selection circuits 40, 43 turn on.

The sampling transistor SP turns on in response to the sampling signal based on the horizontal start signal STH so that the analog image signal is provided to the drain signal line 61 through the data signal line 62.

The scanning signal is provided to the gate signal line 51 in accordance with the vertical start signal STV. When the TFT 71 turns on in response to the scanning signal, the analog image signal Sig is applied, through the drain signal line 61, to the pixel electrode 80 and the storage capacitor element 85, which hold the applied voltage. The liquid crystal 21 aligns itself in accordance with the image signal voltage applied to the liquid crystal 21, resulting in a display image.

This analog display mode is suitable for showing a fall-color moving image because the image signal voltage is successively inputted. However, the external LSI 91 on the circuit board 90, and drivers 50, 60 continuously consumes the electric power for driving the liquid crystal display device.

(2) Digital Display Mode

When the digital display mode is selected in response to the display mode selection signal MD, the data signal line 62 is set to receive the digital image signal. At the same time, the voltage of the circuit selection signal line 88 turns to H, and the retaining circuit 110 is set to be operable. Further, the TFTs 41, 44 of the circuit selection circuits 40, 43 turn off and the TFTs 42, 45 turn on.

The panel drive LSI 91 on the external circuit board 90 sends start signal STH to the gate driver 50 and the drain driver 60. In response to the start signal, sampling signals are sequentially generated and turn on the respective sampling transistors SP1, SP2, . . . , SPn sequentially, which sample the digital image signal Sig and send it to each of the drain signal lines 61.

Now, the operation of the first row of the matrix, or the portion of the circuit connected to the gate signal line 51, which receives the scanning signal G1, will be described below. First, the scanning signal G1 turns on each TFT of the pixel elements (P11, P12, . . . , P1n) connected to the gate signal line 51, for one horizontal scanning period.

In the pixel element P11 located at the upper left corner of the matrix, the sampling transistor SP1 takes in the digital signal S11 and feeds it to the drain signal line 61. The TFT 72 turns on in response to the scanning signal G1, and the drain signal D1 is written to the retaining circuit 110.

During this writing period, the voltage Vdd supplied to the two inverter circuits of the retaining circuit 110 is set up to be the minimum level (for example, of 3V) necessary for the retaining circuit to hold the data. Thus, when the on-state resistance of the N-channel TFT of the inverter INV2 shown in FIG. 1 goes up, the threshold voltage of the inverter INV1 goes down. That is, when the H level data of the drain signal D1 (digital image signal S11) is written under the condition that the output node of the inverter INV1 is at H level, the flexibility in writing is improved.

That is, since the voltage at the H level of the drain signal D1 (digital image signal S11) can be lowered, the voltage of the driver circuit of the drain driver 60 can also be lowered. Also, the size of the TFT, which configures the pixel element circuit 70 can be made smaller. The signal held by the retaining circuit 110 is inputted to the signal selection circuit 120, which then selects either the signal A or signal B. The selected signal is applied to the pixel electrode 80 and the voltage is applied to the liquid crystal 21. In this manner, all the gate signal lines 51 from the first line to the last gate signal line 51 are scanned, and the writing for one screen display (one field period) is completed.

Then, the display based on the data held by the retaining circuit 110 (display of still image) is carried out. Then, according to the writing period end signal Vend, the voltage booster 95 starts the operation for raising the voltage of the power voltage Vdd supplied to the retaining circuit 110. Here, it is desirable that the voltage Vdd be higher than the sum of the highest signal A, B and the threshold voltage (Vt) of the TFTs 121, 122.

Under this condition, the signals A and B are supplied to the pixel electrode 80 through the TFTs 121, 122 without lowering the level, resulting in the high quality screen display.

In the digital mode, the voltages supplied to the gate driver 50, the drain driver 60 and the external panel drive LSI 91 stops the operation for halting the drive. The voltages Vdd, Vss are always supplied to the retaining circuit 110 for driving. Also, the common electrode voltage is supplied to the common electrode 32 and each of the signals A and B is supplied to the selection circuit 120.

When the voltages Vdd, Vss are supplied to the retaining circuit 110, the common electrode voltage Vcom (signal A) is applied to the common electrode 32, and the liquid crystal display panel 100 is in a normally-white (NW) mode, the signal A receives the same voltage as the common electrode 32 and the signal B receives the AC drive voltage (for example, of 60 Hz) for driving the liquid crystal. By this, it is possible to hold the data and display one still image. Here, the voltage is not applied to the gate driver 50, drain driver 60 and external LSI 91.

When the retaining circuit 110 receives the digital image signal of H through the drain signal line 61, the first TFT 121 of the signal selection circuit 120 receives a L signal and accordingly turns off, and the second TFT 122 receives a H signal and turns on. In this case, the signal B is selected and the liquid crystal 21 receives the signal B having a phase opposite to the signal A applied to the common electrode 32, resulting in the rearrangement of the liquid crystal 21. Since the display panel is in a NW mode, a black image results.

When the retaining circuit 110 receives the digital image signal of L through the drain signal line 61, the first TFT 121 of the signal selection circuit 120 receives a H signal and accordingly turns on, and the second TFT 122 receives a L signal and turns off.

In this case, the signal A is selected and the liquid crystal 21 receives the signal A, which is the same as the signal A applied to the common electrode 32. As a result, there is no change in the arrangement of the liquid crystal 21 and the pixel element stays white.

In this way, by writing and holding the data for one image display, it is possible to display the data as a still image. In this case, each of the drivers 50, 60 and the LSI 91 stop their drive resulting in the reduction of the electric power consumption.

As described above, the embodiment of this invention is capable of functioning as the two kinds of display, full color moving picture display (analog display mode) and digital depth display (digital display mode) with single liquid crystal display panel 100. It also prevents the erroneous operation of the retaining circuit 110 during the data writing. It also enables the reduction of the consumption of the electric power as well as the fine layout of the pixel elements.

Although the display device capable of selecting between the analog display mode and the digital display mode is explained in the embodiment described above, this invention can be broadly applied to the display device which has the retaining circuit 110 for writing and holding the digital image signal and which displays an image according to its retained signal.

It is preferable that the display device of this invention be applied to a liquid crystal display, especially to a reflection-type liquid crystal display device. A device structure of a reflection-type liquid crystal display device will be described below in reference to FIG. 5.

Figure 5:
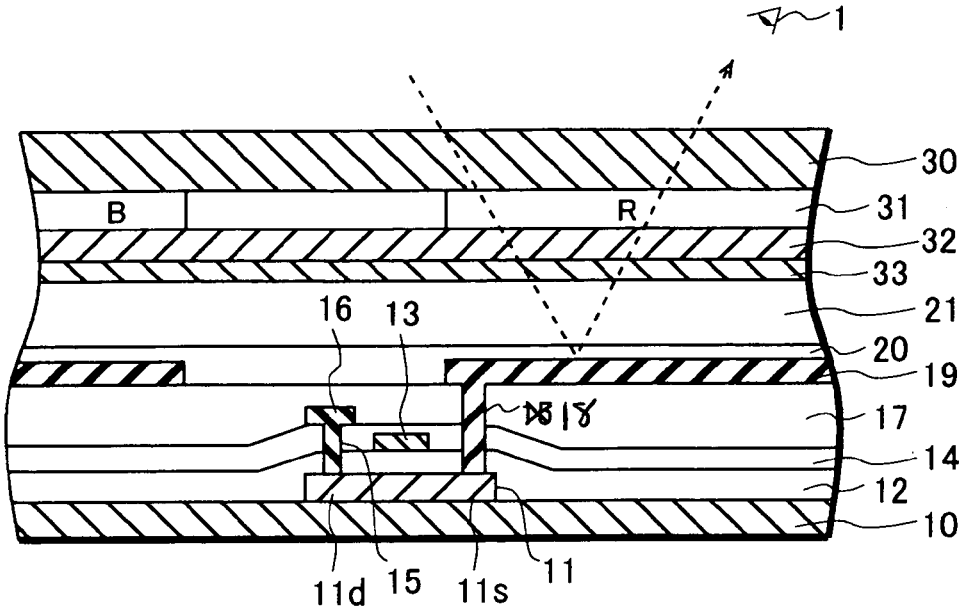
FIG. 5 is a cross-sectional view of a reflection type liquid crystal display device.

In FIG. 5, the element denoted by the reference numeral 10 is an insulating substrate on one side of the display device, and the element denoted by the reference numeral 11 is an isolated polysilicon semiconductor layer 11 on the substrate 10. A gate insulating film 12 is formed on top of the polysilicon semiconductor layer 11, and a gate electrode 13 is formed on the portion of the insulating film 12 corresponding to the polysilicon semiconductor layer 11.

A source 11*s* and a drain 11*d* are formed in the semiconductor layer 11 at the portions located at both sides of the gate electrode 13. An interlayer insulating film 14 is deposited above the gate electrode 13 and the gate insulating layer 12. Contact holes 15 are formed at the portions of the interlayer insulating film 14 corresponding to the drain 11*d* and the source 11*s*. The drain 11*d* is connected to a drain electrode 16 through the contact hole 15, and the source 11*s* is connected to a pixel electrode 19 through the contact hole 18 piercing through the interlayer insulating film 17 formed on the interlayer insulating film 14.

The pixel electrode 19 is formed on the flattening insulating film 17 and is made of a reflecting electrode material, for example, an aluminum (Al). An orientation film 20 is formed on the pixel electrode 19 and the portions of the flattening insulating film 17 not covered by the pixel electrode 19. The orientation film 20 is made of polyimid and aligns the liquid crystal 21.

The insulating substrate 30 on the other side of the display device has color filter 31 for generating red (R), green (G), and blue (B) colors, a common electrode 32 made of a transparent electrode material such as ITO (indium tin oxide), and an orientation film 33 for aligning the liquid crystal 21.

The liquid crystal 21 fills the gap between the two insulating substrates 10, 30, which are attached together by sealing the peripheral portions of the two insulating substrates with a sealing adhesive such that there is a predetermined space for the liquid crystal 21 between them.

As shown in the figure, the light coming from an observer 1 side through the common electrode 32 and incident on the pixel electrode 19 is reflected by the pixel electrode 19 so that the observer 1 recognizes the light modulated by the liquid crystal 21 of the display device.

In this configuration, the display device utilizes the light external to the device and does not need an internal light source such as the one known as a back light in the transmitting-type liquid crystal display. By applying the display device of this invention to the reflection-type liquid crystal display device, it is possible to further reduce the consumption of the electric power since there is no need for the internal light source consuming the electric power in the reflection-type display device.

In the embodiment described above, the voltage to the common electrode and the signals A and B are applied to the respective terminals throughout one full dot scan period of a field. The display device of this invention is not limited to that embodiment, and includes a to configuration in which those voltages are not applied throughout the scan. Such a configuration is preferable because of a further reduction of the consumption of the electric power by the display device.

Furthermore, in the above embodiment, one bit digital data signal is used in the digital display mode. The display device of this invention is not limited to that embodiment, and is also applied to a multiple bit digital data signal system in which a multiple level image representation is possible. In this configuration, the retaining circuits and the signal selection circuits are provided in accordance with the number of the bits used in the system.

Still furthermore, in the above embodiment, only a portion of the liquid crystal display panel is used for displaying the still image. The display device of this invention is not limited to that embodiment, and the still image may be displayed in the entire area of the display panel.

Furthermore, in the above embodiment, the reflection-type liquid crystal display device is used. The display device of this invention is not limited to that embodiment, and is applied to the transmitting-type liquid crystal display device. In that case, the pixel electrode is made of a transparent electrode material, rather than a reflecting electrode material, at least in the area of the pixel element including portions corresponding to the TFTs, the retaining circuit, signal selection circuit and the signal wiring. Even if this invention is applied to the transmitting-type liquid crystal display device, it is possible to reduce the consumption of the electric power by stopping supplying the voltage to the gate driver 50, drain driver 60 and external panel drive LSI 91 after displaying one screen.

Figure 6:
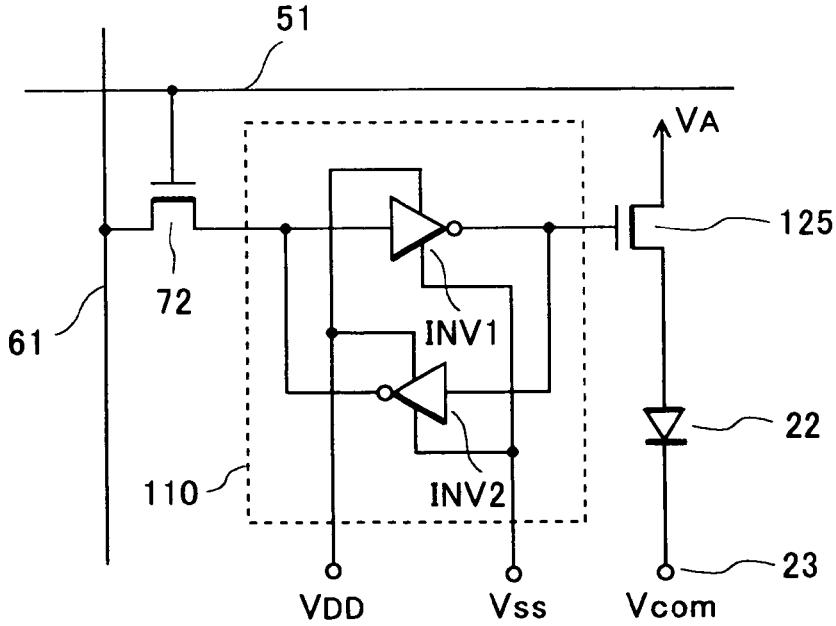
FIG. 6 is a circuit diagram of EL display device of the second embodiment of this invention.
Figure 7:
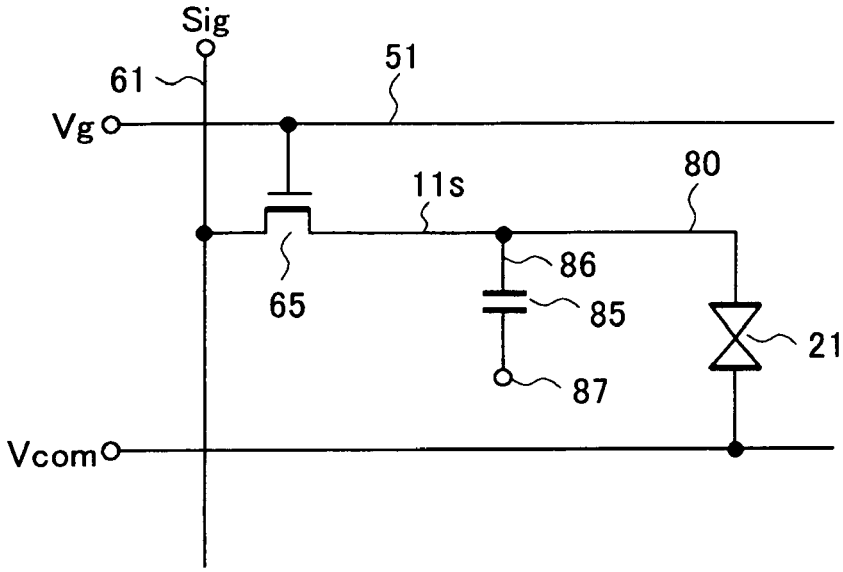
FIG.7 PRIOR ART
FIG. 7 is a circuit diagram of a conventional liquid crystal display device.
Figure 8:
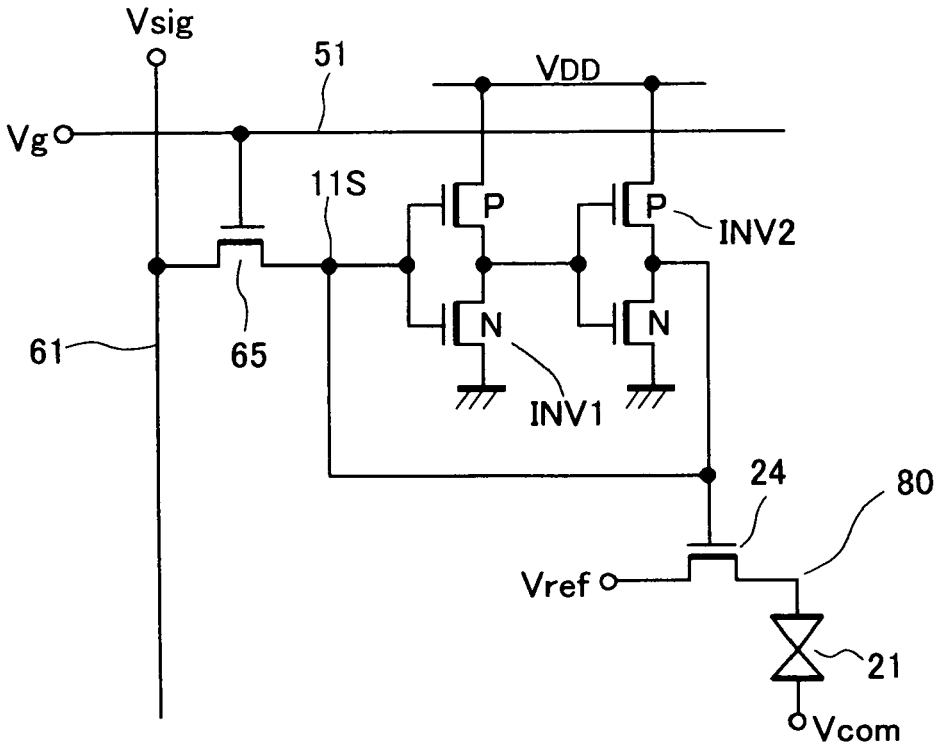
FIG.8 PRIOR ART
FIG. 8 is another circuit diagram of a conventional liquid crystal display device.
Figure 9:
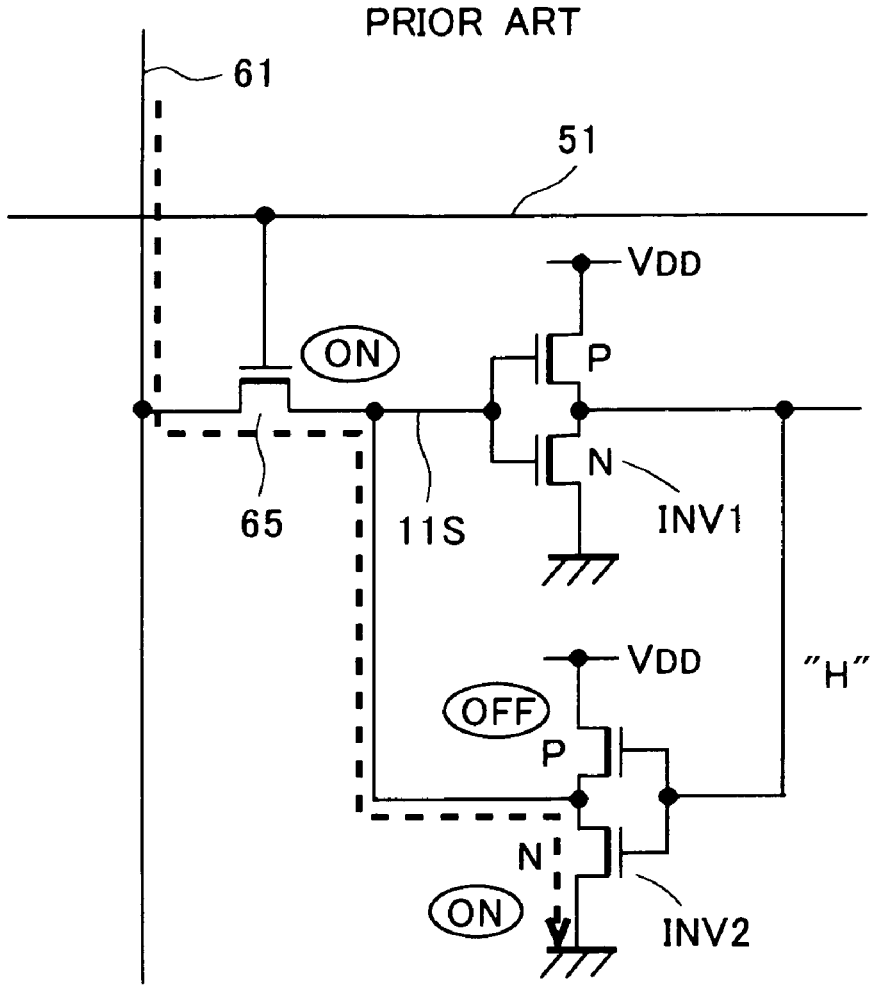
FIG. 9 is a circuit diagram explaining the problems of a conventional liquid crystal display device.

Next, the display device relating to the second embodiment of this invention will be explained. FIG. 6 is a circuit diagram of the EL (electro-luminescence) display device of the second embodiment of this invention. The pixel element selection TFT 72 is formed near the crossing of the gate signal line 51 and the drain signal line 61 and the source of the TFT 72 is connected to the retaining circuit 110. The retaining circuit 110 comprises two inverter circuits INV1 and INV2, which are positively fed to each other.

The output from the retaining circuit 110 is applied to the N-channel EL drive TFT 125. The source of the EL drive TFT is connected to the voltage source VA and the drain is connected to the anode of the organic EL element 22. The cathode 33 of the organic EL element 22 is biased to the common voltage Vcom.

Here, in the same manner as the embodiment described above, the digital image data from the drain signal 61 is written to the retaining circuit 110. During the data writing of period, the voltage Vdd supplied to the two inverter circuits of the retaining circuit 110 is set up to be the minimum level (for example, of 3V) necessary for the retaining circuit to hold the data.

When a H signal is outputted from the retaining circuit 110, relatively low voltage (for example, of 3V) is applied to the gate of the EL drive TFT 125. By adjusting the threshold voltage of the EL drive TFT 125, the organic EL element 22 is in an off-state or in a high resistance state and the light is off.

Then, upon the completion of the data writing, the voltage Vdd is raised during the display (display of the still image) of the data held by the retaining circuit 110. Then, the voltage of the gate of the EL drive TFT 125 is also raised. Thus, the bias higher than VF is added to the anode of the organic EL element 22, which is in an on-state, and the light turns on.

Therefore, in the EL display device of the above configuration, it is possible to reduce the consumption of the electric power by keeping the voltage Vdd low during the data writing period, in the same manner as the embodiment described above. Also, by raising the voltage Vdd after the data writing period, the organic EL element turns on, resulting in a high quality luminescent display According to this invention, in the display device having the retaining circuit for holding digital image data in each of the pixel elements, since the power voltage supplied to the retaining circuit is set up to be low during the writing period, and the voltage is raised during the display after the writing period, it is possible to prevent the erroneous writing of the data to the retaining circuit and to reduce the consumption of the electric power.

Also, according to the display device of this invention, since the pixel element selection element can be made small, it is possible to have a fine layout of the pixel elements.

The above is a detailed description of particular embodiments of the invention. It is recognized that departures from the disclosed embodiments may be made within the scope of the invention and that obvious modifications will occur to a person skilled in the art. The full scope of the invention is set out in the claims that follow and their equivalents. Accordingly, the claims and specification should not construed to narrow the full scope of protection to which the invention is entitled.

What is claimed is:

1. A display device comprising:

a plurality of gate signal lines disposed in a predetermined direction on a substrate;

a plurality of drain signal lines disposed on the substrate in a direction different from the predetermined direction;

a plurality of pixel elements which are disposed on the substrate as a matrix, each of the pixel elements being activated by a scanning signal fed through a corresponding gate signal line and provided with an image signal fed through a corresponding drain signal line;

a retaining circuit provided in at least one of the pixel elements in which a digital image signal fed from the corresponding drain signal line is written in response to the scanning signal fed from the corresponding gate signal line; and a voltage booster which raises a power voltage supplied to the retaining circuit after a completion of writing of the digital image signal;

wherein an output of the retaining circuit determines a representation of an image displayed in the display device.

2. The display device of claim 1, wherein the retaining circuit comprises two inverter circuits which are positively fed back to each other.

3. The display device of claim 2, wherein each of the inverter circuits comprises a CMOS inverter circuit.

4. The display device of claim 1, further comprising a signal selection circuit which selects a signal to be supplied to a pixel electrode of a corresponding pixel element in response to the output of the retaining circuit, the signal selection circuit comprising two thin film transistors, the output of the retaining circuit being applied to gates of the thin film transistors.

5. The display device of claim 4, wherein a voltage raised by the voltage booster is higher than a sum of a voltage of the selected signal to be supplied to the pixel electrode and a threshold voltage of a corresponding thin film transistor.

6. A method for driving a display devices comprising:

providing a display device comprising a plurality of pixel elements disposed as a matrix;

providing each of the pixel elements with a digital image signal fed through a drain signal line;

writing, in each of the pixel elements, the digital image signal provided from a corresponding drain signal line in a corresponding retaining circuit in response to a signal fed from a corresponding gate signal line;

raising the power voltage supplied to the retaining circuits using a voltage booster after a completion of writing of one writing period; and displaying an image in accordance with the digital image signals written in the retaining circuits.

7. The method for driving a display device of claim 6, wherein the retaining circuit comprises two inverter circuits which are positively fed back to each other.

8. The method for driving a display device of claim 7, wherein each of the inverter circuits comprises a CMOS inverter circuit.

9. The method for driving a display device of claim 6, further comprising providing for each of the retaining circuits a signal selection circuit which selects a signal to be supplied to a pixel electrode of a corresponding pixel element in response to an output of the retaining circuit, the signal selection circuit comprising two thin film transistors, the output of the corresponding retaining circuit being applied to gates of the thin film transistors.

10. The method for driving a display device of claim 9, wherein a voltage raised by the voltage booster is higher than a sum of a voltage of the signal to be supplied to the pixel electrode and a threshold voltage of a corresponding thin film transistor.

* * * * *